US008511763B2

(12) United States Patent
Salice

(10) Patent No.: US 8,511,763 B2
(45) Date of Patent: Aug. 20, 2013

(54) SELF-CLOSING DEVICE FOR A DRAWER OR FOR A MOVEABLE PART OF A PIECE OF FURNITURE

(75) Inventor: Luciano Salice, Carimate (IT)

(73) Assignee: Arturo Salice S.p.A., Novedrate (Como) (IT)

( * ) Notice: Subject to any disclaimer, the term of this patent is extended or adjusted under 35 U.S.C. 154(b) by 228 days.

(21) Appl. No.: 13/063,311

(22) PCT Filed: Aug. 4, 2009

(86) PCT No.: PCT/EP2009/005622

§ 371 (c)(1),
(2), (4) Date: Mar. 10, 2011

(87) PCT Pub. No.: WO2010/028722

PCT Pub. Date: Mar. 18, 2010

(65) Prior Publication Data

US 2011/0156561 A1 Jun. 30, 2011

(30) Foreign Application Priority Data

Sep. 12, 2008 (IT) ..... MI2008A1636

(51) Int. Cl.
*A47B 88/00* (2006.01)

(52) U.S. Cl.
USPC ..... 312/333; 312/319.1

(58) Field of Classification Search
USPC ..... 312/333, 334.44–334.47, 319.1, 312/334.6; 384/21, 22
See application file for complete search history.

(56) References Cited

U.S. PATENT DOCUMENTS

| | | | | |
|---|---|---|---|---|
| 5,364,179 | A * | 11/1994 | Brustle et al. | 312/333 |
| 5,474,375 | A * | 12/1995 | Hollenstein et al. | 312/319.1 |
| 6,736,471 | B2 * | 5/2004 | Lin | 312/333 |
| 6,846,053 | B2 * | 1/2005 | Salice | 312/334.14 |
| 7,374,260 | B2 * | 5/2008 | Lu | 312/333 |
| 7,399,041 | B2 * | 7/2008 | Prentner et al. | 312/333 |
| 7,472,973 | B2 * | 1/2009 | Huang | 312/333 |
| 7,854,485 | B2 * | 12/2010 | Berger | 312/333 |
| 8,240,787 | B2 * | 8/2012 | Chen et al. | 312/333 |

(Continued)

FOREIGN PATENT DOCUMENTS

| | | |
|---|---|---|
| DE | 20 2007 018 055 U1 | 3/2008 |
| WO | 2008/031814 A1 | 3/2008 |

OTHER PUBLICATIONS

International Search Report and Written Opinion dated Mar. 17, 2010 from PCT/EP2009/005622.

*Primary Examiner* — Janet M Wilkens
(74) *Attorney, Agent, or Firm* — Ohlandt, Greeley, Ruggiero & Perle, L.L.C.

(57) ABSTRACT

Disclosed is a self-closing device for a drawer or for a moveable part of a piece of furniture that includes a support body for a slider moveable within a guide between a rear and a front position and vice versa by the action of a first elastic element. The slider is actuated by a drawing element integral with an extractable part affixed to the drawer or the like, the guide, at the area corresponding to the rear position of the slider, includes an element for moving the slider, suitable for engaging with an element for guiding the slider during its engagement with a drawing part present on the drawing element. There is further provided a stop element against which the slider lies directly or indirectly before engaging with a first guide element.

18 Claims, 4 Drawing Sheets

(56) References Cited

U.S. PATENT DOCUMENTS

| | | | | |
|---|---|---|---|---|
| 8,240,788 | B2 * | 8/2012 | Juan et al. | 312/333 |
| 2007/0132346 | A1 * | 6/2007 | Huang | 312/333 |
| 2007/0278919 | A1 * | 12/2007 | Lu | 312/333 |
| 2009/0278430 | A1 * | 11/2009 | Liang et al. | 312/319.1 |
| 2010/0007254 | A1 * | 1/2010 | Zimmer et al. | 312/333 |
| 2011/0210653 | A1 * | 9/2011 | Salice | 312/319.1 |
| 2011/0215690 | A1 * | 9/2011 | Juan et al. | 312/319.1 |
| 2011/0254416 | A1 * | 10/2011 | Salice | 312/319.1 |

* cited by examiner

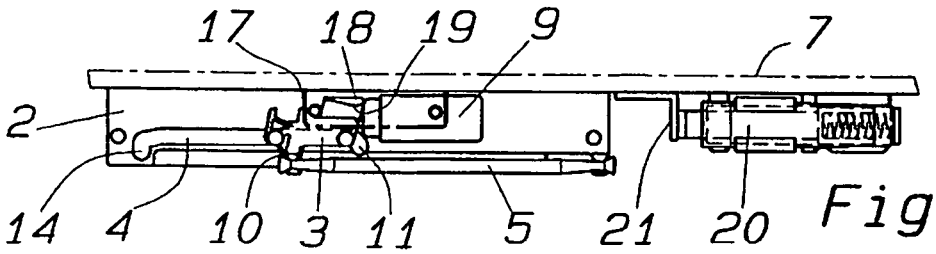
Fig. 3
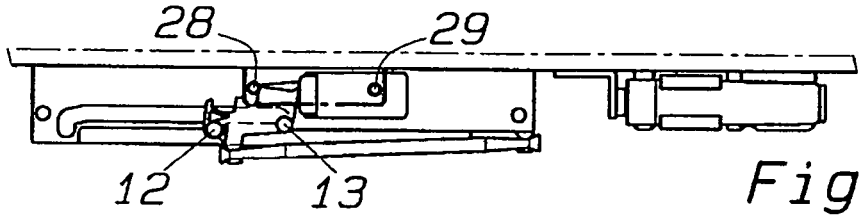
Fig. 4
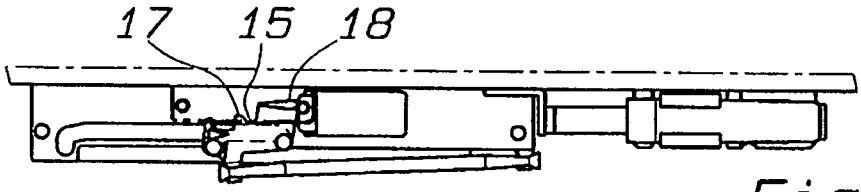
Fig. 5
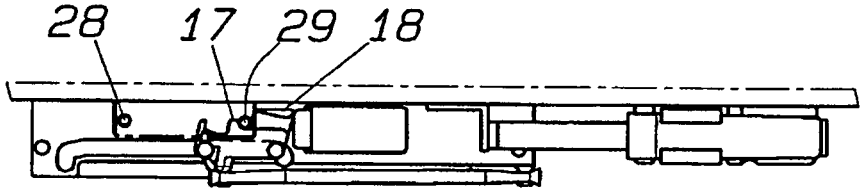
Fig. 6
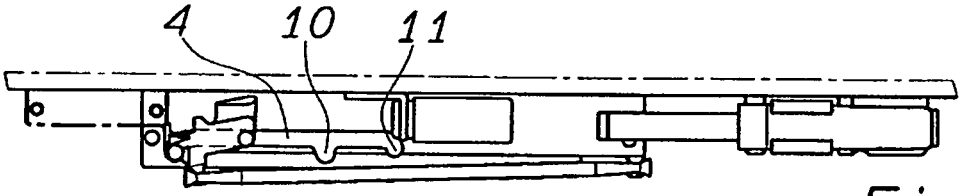
Fig. 7
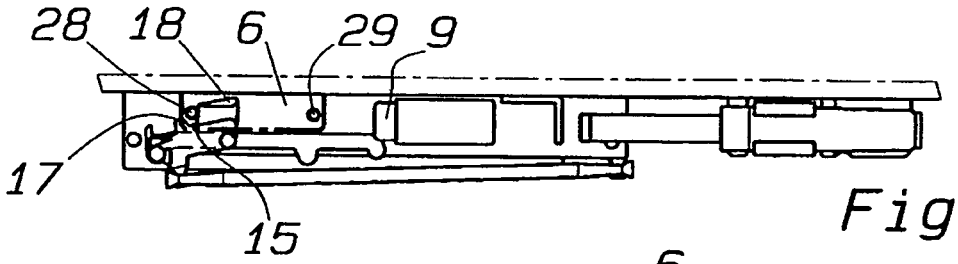
Fig. 8
Fig. 9
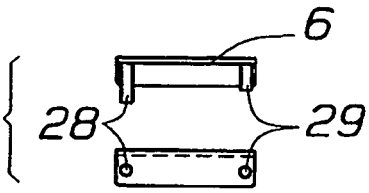

SELF-CLOSING DEVICE FOR A DRAWER OR FOR A MOVEABLE PART OF A PIECE OF FURNITURE

BACKGROUND OF THE DISCLOSURE

1. Field of the Disclosure

The present invention relates to a self-closing device for a drawer or for a moveable part of a piece of furniture.

2. Background of the Disclosure

As it is known, devices have long been known on the market for carrying out almost automatically the opening and/or closing of moveable parts of pieces of furniture, for example a drawer of a piece of furniture.

By way of an example, a device called ratchet is currently used for opening a door or a drawer of a piece of furniture, which substantially has a thrust element that is released by a light pressure and when released, under an elastic force, imparts a thrust to the drawer that causes a controlled movement thereof capable of allowing the user to grip the drawer to fully open it, especially if this has no handles.

On the contrary, a self-closing device is used for closing a drawer, which is normally associated to the fixed guide of the drawer and has a support body of a slider that is movable within a groove obtained in the body itself.

Normally, the slider moves within the contrast groove and by the action of a spring and is actuated by a drawing element that is integral with the extractable guide of the drawer.

The drawer opening causes the actuation of the self-closing device that, when the drawer is closed, in the last portion of its path picks it up for example by a pin, and returns it to the fully closed position by means of the spring.

Normally, a decelerator also works in cooperation with the self-closing device which absorbs the closing of the drawer dampening the shock that would occur by the effect of the closing spring of the same.

In the light of the above it is easily understood how difficult it is to combine an automated opening system, for example of a drawer, with a self-closing device of the same, since normally the forces at play of the ratchet and of the self-closing device tend to oppose each other preventing the opening or closing of the drawer.

Systems sometimes very complex have therefore been designed, that to this end also use parts moved by electrical motors to compensate the forces at play and allow an almost automatic, although partial, opening and closing of a drawer.

Such solutions sometimes are little effective, because besides making the device highly complex, they easily tend not to have a continuous operation over time, require continuous maintenance and have high costs that for some types of furniture advise against the application thereof.

SUMMARY OF THE DISCLOSURE

The technical task of the present invention therefore is to provide a self-closing device for a drawer or for a moveable part of a piece of furniture which allows eliminating the technical drawbacks of the prior art.

Within this technical task, an object of the invention is to provide a self-closing device for a drawer or the like of a piece of furniture which is combinable with an opening system of the same and which is reliable and very easy to operate, ensuring the effectiveness thereof for a long period over time without requiring any kind of ordinary or extraordinary maintenance to this end. Another object of the invention is to provide a self-closing device for a drawer or the like of a piece of furniture which can be mounted with no difficulty by non-specialized personnel too, thus allowing a replacement or adjustment thereof by the user in the event of need, and which among the other things has a low cost that can facilitate the spread thereof on the market.

Last but not least, another object of the invention is to provide a self-closing device for a drawer or the like of a piece of furniture which can be mounted on any type of piece of furniture occupying a moderate space and without altering at all the aesthetics of the piece of furniture as it is movable since substantially seated on the sliding guides for example of a drawer.

The technical aim, and these and other objects according to the present invention are achieved by providing a self-closing device for a drawer or for a moveable part of a piece of furniture according to claim 1.

Substantially, the first means for moving the slider, in cooperation with the stop element, allow releasing the slider from the drawing element subsequent to an external stress at the closed position of the drawer or the like, releasing it from the action of the closing device and allowing the movement thereof in the opening direction.

Further features of the present invention are also defined in the subsequent claims.

BRIEF DESCRIPTION OF THE DRAWINGS

Further features and advantages of the invention will appear more clearly from the description of preferred but non-exclusive embodiments of the self-closing device for a drawer of a piece of furniture according to the invention, illustrated by way of a non-limiting example in the annexed drawings, wherein:

FIG. 3 shows a plan view of the device of figure when the drawer (not shown) is in closed position;

FIG. 4 shows the device according to FIG. 3 after the drawer has undergone a slight thrust that causes a further recess thereof inside the piece of furniture and causes the movement of the slider in contrast to the action of the second spring;

FIG. 5 shows, for the device of FIG. 1, the release of the drawing element by the slider and consequently the protrusion of the drawer from the piece of furniture by such an extent as to allow the grip thereof by the user;

FIG. 6 shows, for the device of FIG. 1, the step wherein, by the external action of the user, the drawing element has moved and hooked again the slider of the closing device;

FIG. 7 shows, for the device of FIG. 1, the step wherein the further opening of the drawer has caused the loading of the first elastic means of the closing device;

FIG. 8 shows, for the device of FIG. 1, the step of the last closing portion of the drawer, wherein the device picks it up and returns it to the starting position, as shown in FIG. 3;

FIG. 9 shows, for the device of FIG. 1, the drawing element respectively seen in side elevation and in plan view;

DETAILED DESCRIPTION OF THE DISCLOSURE

Figure 1:
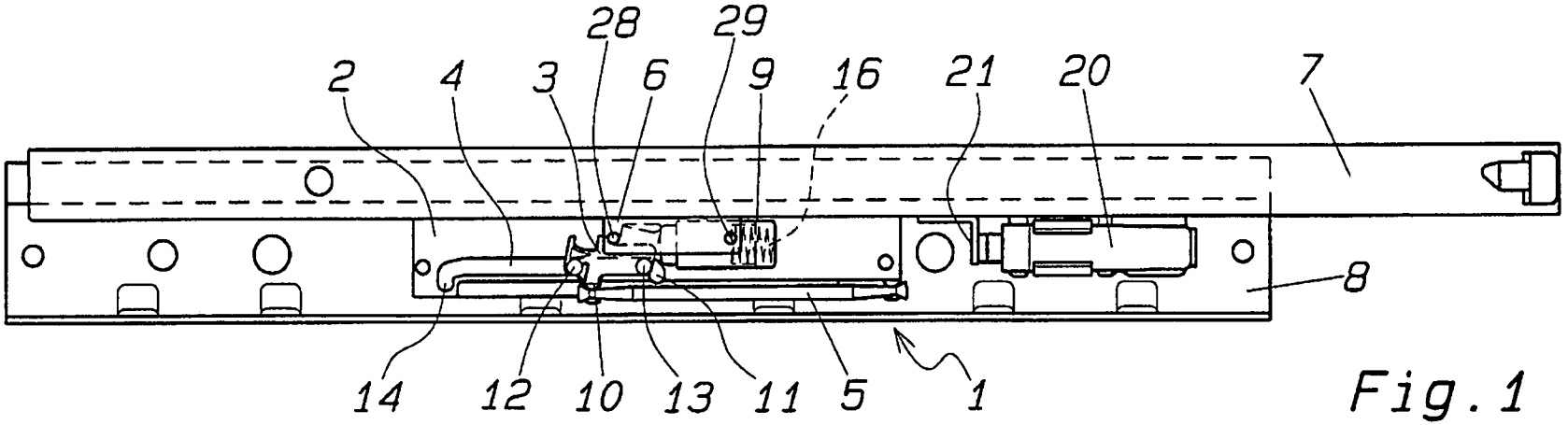
FIG. 1 shows a plan view of the right part of a guide for drawers with the self-closing device according to a first preferred embodiment of the invention and an ejection device.

Equivalent parts in the different embodiments of the invention will be indicated with the same reference numeral.

With reference to the above figures, there is shown a self-closing device for a piece of furniture or for a moveable part of a piece of furniture, according to the invention, globally indicated with reference numeral 1.

The device is preferably associated to a fixed part 8 of the piece of furniture and has a support body 2 for a slider 3 movable within a groove 4 between a rear position and a front position and vice versa in contrast and by the action of first elastic means, in particular a first spring 5.

In particular, guide 4 is shaped as a groove.

Slider 3 is actuated by a drawing element 6 integral with an extractable part 7 associated to the drawer or the like.

However, it is equally possible to associate device 1 to the extractable part 7 and the drawing element 6 to the fixed part 8.

Guide 4 in the zone corresponding to the rear position of slider 3 comprises first movement means of slider 3 suitable for engaging with first guide means of the same slider 3 during the engagement thereof with drawing means provided on the drawing element 6.

A stop element 9 is further provided, against which slider 3 lies directly or indirectly before engaging with the first guide means in the first moving means.

Stop element 9 may be surpassed by the action of an externally applicable force.

More in detail, the drawing means comprise a first and a second pin 28 and 29 spaced from each other and of different length suitable for alternately engaging with slider 3, as will be better explained hereinafter.

The first movement means comprise an intermediate lateral cavity 10 and a rear curve 11 of guide 4.

The first guide means of slider 3 comprise a third and a fourth pin 12 and 13 engaged in guide 4 or in the intermediate lateral cavity 10 and in the rear curve 11 of the guide, which further has a front curve 14.

As said, the first elastic means comprise a first spring 5.

Figure 2:
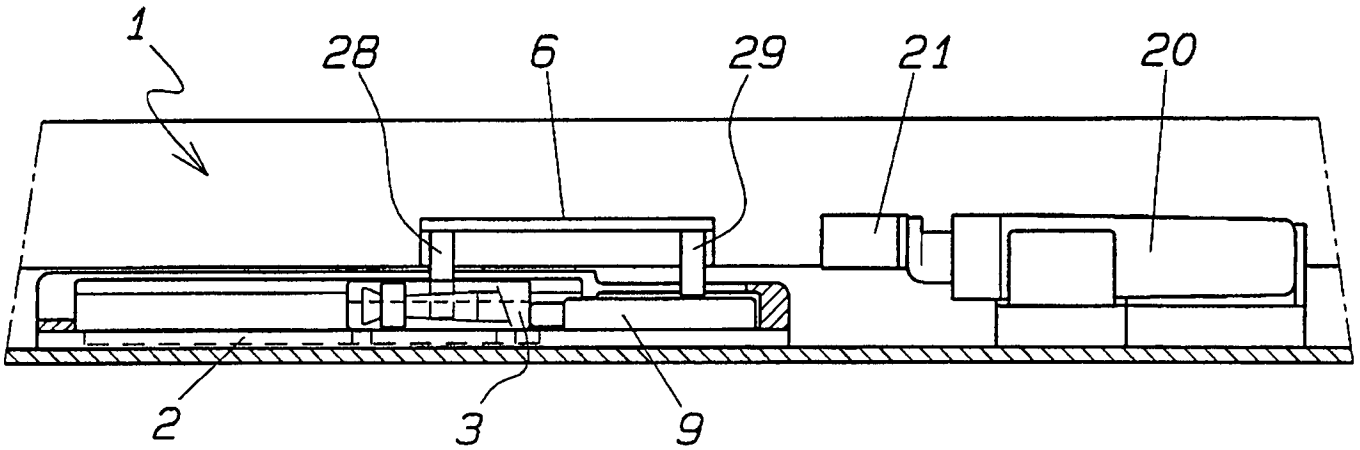
FIG. 2 shows an enlarged side elevation view of the self-closing device of FIG. 1.
Figure 10:
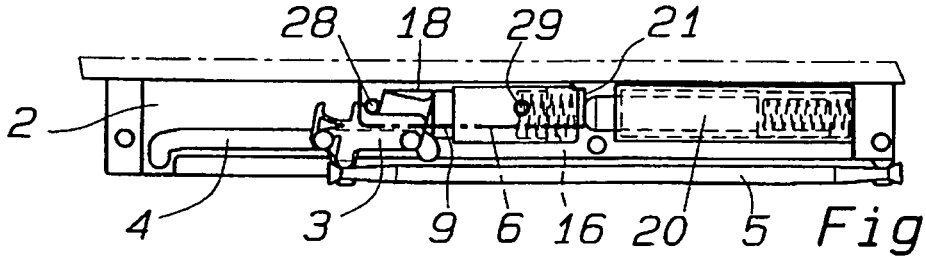
FIGS. 10 to 15 show the same device shown before but with the ejector integrated in the self-closing device.
Figure 11:
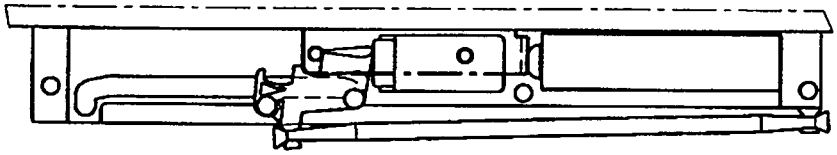
Figure 12:
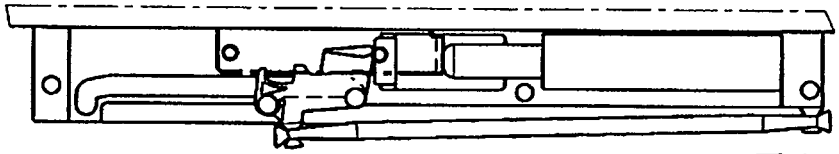
Figure 13:
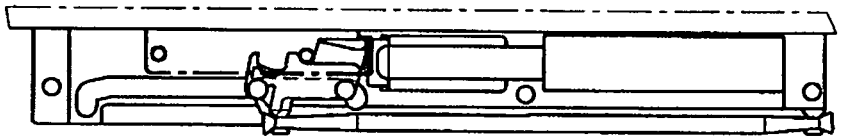
Figure 14:
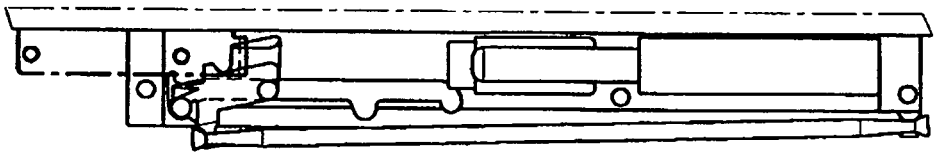
Figure 15:
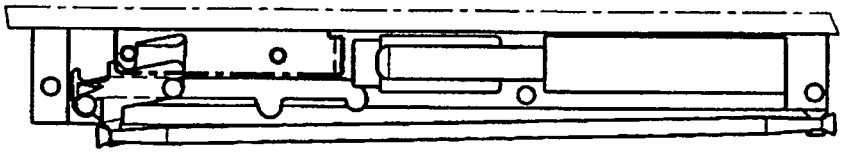

Let's now refer to the first embodiment of the present invention shown in FIGS. 1-15.

Stop element 9 is elastically yielding and comprises a second spring 16.

Suitably, the first spring 5 has an elastic force weaker than that of the second spring 16 so that the yielding stop element 9, when slider 3 is free to slide, is capable of stopping it in the position corresponding to the closed position of the drawer or the like.

Figure 16:
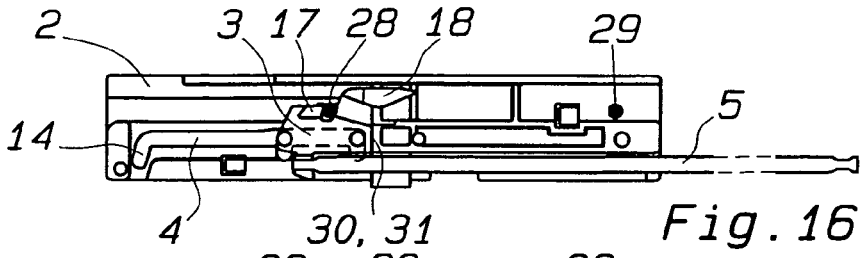
FIGS. 16 to 21 show, for a self-closing device according to a second preferred embodiment of the invention, the operating steps that correspond to the operating steps highlighted in FIGS. 3 to 8 for the self-closing device according to the first preferred embodiment of the invention.
Figure 17:
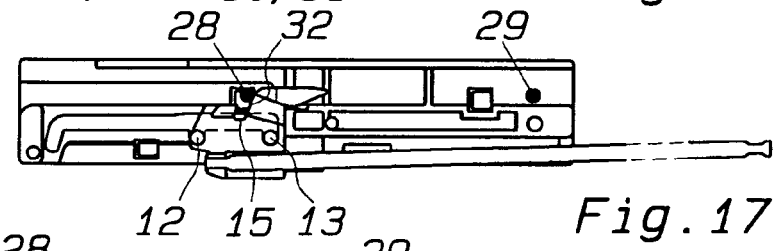
Figure 18:
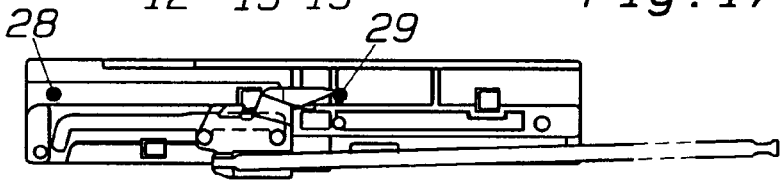
Figure 19:
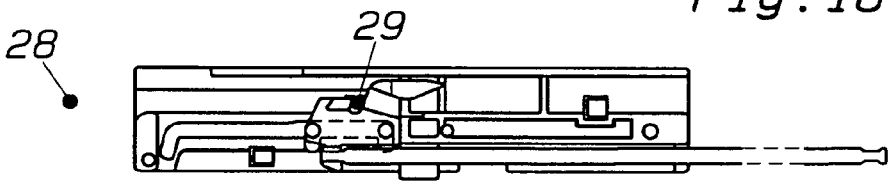
Figure 20:
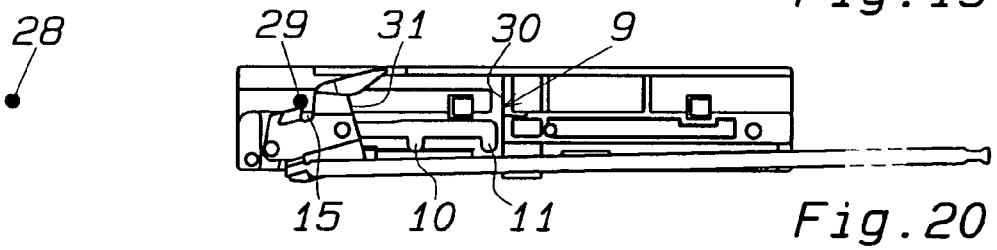
Figure 21:
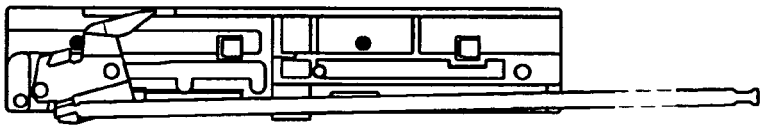
Figure 22:
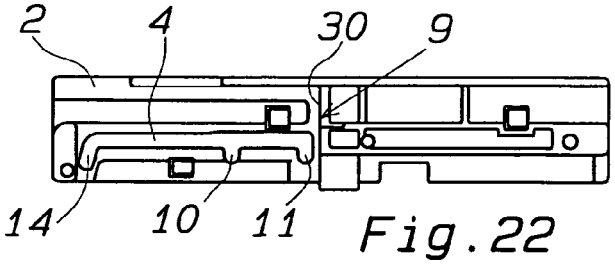
FIG. 22 shows the support body of the self-closing device of FIGS. 16 to 21.
Figure 23:
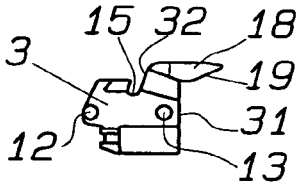
FIG. 23 shows only the slider of the self-closing device of FIGS. 16 to 21.

Let's now refer to the second embodiment of the present invention shown in FIGS. 16-23.

Stop element 9 is mechanical and comprises a step 30 of the support body 2, arranged crosswise the movement direction of slider 3, against which it lies with its own corresponding wall 31. Such support is ensured by surfaces 30 and 31 being on the same surface in contact with each other and by the force exerted by the first spring 5, that makes them adhere without allowing oscillations of slider 3.

With reference now again to both preferred embodiments of the invention, slider 3 comprises a tooth 17 wherein the first and second pin 28 and 29 provided on the drawing element 6, engage alternately, as will be seen hereinafter.

Slider 3 is also provided with a cavity 15 arranged between tooth 17 and a projection 18, which has a side surface shaped as a cam 19 capable of engaging with the second pin 29.

Device 1 may be associated to translation means suitable for moving the drawer in the proximity of its closed position along a small portion of its extraction stroke substantially equal to the distance between the first and the second pin 28 and 29.

In particular, in a preferred but non-exclusive solution, shown in FIGS. 1-15, the translation means comprise an ejector 20 suitable for interacting with a stop element 21 integral with the extractable guide 7.

Ejector 20 is suitable for moving, as a consequence, the drawer along said small extraction portion, but its force is weaker than the force exerted by the first spring 5.

In an embodiment version not shown, the translation means may be defined by a suitable inclination, not shown, of the fixed and/or sliding guides of the drawer, wherealong the latter can slide by gravity.

In a further embodiment version, the translation means may comprise magnets, not shown herein, oriented for generating repulsion forces capable of allowing the sliding of the drawer and favouring, as in the other cases, the grip thereof by the user.

Suitably, the translation means are provided in a known manner with devices for adjusting the force exerted by them.

The operation of the device according to the invention clearly appears from what described and illustrated, and in particular with reference to the first preferred embodiment of the invention shown in FIGS. 1-15, it substantially is as follows.

FIG. 3 shows the situation of the device when the drawer is closed.

The first stop element 21 rests on ejector 20 which is in retracted position, as it is weaker than the force of the first spring 5, while slider 3 is held thereby in a first rest position within guide 4 and abuts on the elastically yielding stop element 9 that has the second spring 16 not compressed, but only preloaded so as to hold the stop element 9 into position.

In this position, slider 3 holds the first pin 28 of the drawing element 6 by tooth 17, which as said is integral to the extractable part 7.

FIG. 4 shows the step wherein the user wants to open the drawer.

The user exerts a pressure on the drawer such as to cause the partial retraction thereof inside the piece of furniture.

The first stop element 21 partially retracts the head of ejector 20 and at the same time, slider 3 is made to retract by the first pin 28 of the drawing element, in contrast to the second spring of the yielding stop element 9. During this retraction, the third and the fourth pin 12 and 13 engage in the intermediate lateral cavity 10 and in the rear curve 11 of guide 4 by the first spring 5.

In this step, slider 3 shifts orthogonally to the sliding axis of guide 4 concurrently releasing the first pin 28 from tooth 17. When the user stops the pressure on the drawer, ejector 20 can push the drawer outwards by an extent of predetermined length until, as seen in FIG. 5, the second pin 29 engages with projection 18 of the slider.

During this opening step of the drawer, by the effect of pin 29 stressed by ejector 20, projection 18 through cam 19 moves slider 3 back within groove 4 and spring 16 of stop element 9 pushes it to the position shown in FIG. 6, wherein the second pin 29 is engaged with tooth 17.

In this step, the drawer is ejected from the piece of furniture by an extent substantially equal to the distance of the first pin 28 from the second pin 29.

After having gripped the drawer, the user then fully opens it.

The extraction of the drawer consequently causes the drawing of slider 3 within guide 4 in contrast to the first spring 5 until the third pin 12 engages in the front curve 14 of the groove. The slider is held in this position by the first spring 5, loaded.

The partial rotation of slider 3, as shown in FIG. 7, makes the second pin 29 release from tooth 17 leaving the drawer free to open according to the user's requirements.

FIG. 8 shows the step in the last closing portion of the drawer, wherein the drawing element 6 goes beyond the second pin 29 shorter than slider 3 while the longer first pin 28 engages within cavity 15 concurrently releasing the third pin 12 from the front curve 14.

The alignment of slider 3 within guide 4 causes the engagement of the first pin 28 with tooth 17.

In this way, the slider can be returned to the closing direction by the action of the first spring that has a higher elastic force than that of ejector 20, so as to guide in a controlled manner the closing of the drawer up to the position corresponding to FIG. 3 wherein slider 3 lies on the stop element 9.

If all the system needs to be compacted, the ejector may be seated on the support body at the back of the elastically yielding element.

In this case, the drawing element will have the first stop element 21 on the end on the side facing the shorter second pin 29, suitable for engaging with the first stop element 21 suitable for engaging with ejector 20, as shown in FIGS. 10-15.

In this last solution, the operating sequence is the same as the one described above.

Let's now refer to the operation of the self-closing device 1 shown in FIGS. 16-23.

Since now stop element 9 is of the mechanical type, it is not provided with the second spring 16 anymore which thus, compared to the first preferred embodiment of the invention, is eliminated.

The elimination of the second spring 16 simplifies the balancing of forces that must be exerted by the other springs, in particular by the first spring 5 and by the spring of ejector 20, which must already be suitably selected to keep into account the weight variation the drawers may have according to their dimensions and their contents.

By the force applied on the drawer from the outside by the user, the first pin 28 integral to the extractable guide is pushed against an inclined surface 32 of slider 3 arranged within it. The inclined surface 32 causes the side movement of slider 3 along the cross step 30 of the support body 2 and within the suitable lateral cavities 10, 11 of its sliding guide 4, so that pin 28 is removed from its seat shaped as a cavity 15, which keeps it hooked to slider 3. The drawer can thus be pushed open by ejector 20. Ejector 20 is not shown in FIGS. 16-23 since it may be arranged elsewhere and in particular it may consist of the same return spring as the decelerator, now not compressed anymore by the first spring 5, stronger than it.

Modifications and variations, besides those already described, are of course possible, therefore as seen, in place of an ejector there may be provided inclined guides rather than magnets or other systems suitable for moving the drawer.

In the practice, it has been found that the device according to the invention is especially advantageous for allowing the opening and closing of a drawer in a simple and controlled manner, facilitating the grip thereof by the user and providing to the guided closing thereof.

Several changes and variations can be made to the finding thus conceived, all falling within the scope of the inventive concept; moreover, all details can be replaced with technically equivalent elements.

In practice, the materials and the dimensions used can be any, according to requirements and to the state of the art.

The invention claimed is:

1. A self-closing device for a moveable part of a piece of furniture comprising:

a slider adapted to be affixed to a fixed part of the piece of furniture, a support body for the slider, said slider moveable back and forth within a guide between a rear position and a front position by action of a first elastic device, said slider adapted to being actuated by a drawing element integral with an extractable part associated with a moveable part of the piece of furniture, said guide, at a zone corresponding to said rear position of said slider, comprises a first movement device for moving said slider, suitable for engaging with a first guide device for guiding said slider during its engagement with a drawing device present on said drawing element;

a stop element against which said slider lies directly or indirectly before engaging with said first guide device in said first movement device of said guide, wherein said first movement device and said first guide device of said slider allow releasing the engagement of said slider with said drawing element when said slider is stressed so as to compress said stop element.

2. The self-closing device according to claim 1, wherein said stop element is mechanical and comprises a step of said support body against which said slider lies with a wall of said slider.

3. The self-closing device according to claim 2, wherein said slider has a surface inclined with respect to said wall against which said drawing device provided on said drawing element lies.

4. The self-closing device according to claim 1, wherein said stop element is elastically yielding.

5. The self-closing device according to claim 1, wherein said drawing device comprises a first pin and a second pin spaced from each other and adapted to be alternatively engaged with said slider.

6. The self-closing device according to claim 5, wherein said first pin and said second pin have different lengths.

7. The self-closing device according to claim 5, wherein said first guide device further comprises a third pin and a fourth pin engaged in said intermediate lateral cavity and said rear curve of said guide.

8. The self-closing device according to claim 5, wherein said slider comprises a tooth, and wherein said first pin and said second pin of said drawing element are alternatively engaged.

9. The self-closing device according to claim 5, wherein said slider comprises a projection by which it is engaged with said second pin, said projection having a cam-shaped lateral surface.

10. The self-closing device according to claim 1, wherein said guide has a groove and said first movement device comprises an intermediate lateral cavity and a rear curve of said guide.

11. The self-closing device according to claim 10, wherein said guide further has a front curve arranged, with respect to its axis, on the same side where said first movement device is present.

12. The self-closing device according to claim 10, wherein said first elastic device has a first spring, wherein said drawing device comprises a first pin and a second pin spaced a distance from each other and adapted to be alternatively engaged with said slider, and wherein interaction between at least said slider with said drawing element, at least said first spring, said intermediate lateral cavity and said rear curve leave the drawer or the moveable part of the piece of furniture free to slide in proximity to its closed position by a small extraction portion whose length is substantially equal to the distance of said first and said second pin.

13. The self-closing device according to claim 1, wherein said first elastic device has a first spring.

14. The self-closing device according to claim 13, wherein said stop element that is elastically yielding has a second spring, said first spring exerting on the slider at contact with said stop element a weaker elastic force than that of said second spring.

15. The self-closing device according to claim 13, further comprising a translation device for moving said moveable part of the piece of furniture along a small extraction portion with a force weaker than a force of said first spring.

16. The self-closing device according to claim 15, wherein said translation device comprises an ejector suitable for interacting with a stop element integral with said extractable part.

17. The self-closing device according to claim 15, wherein said translation device comprises at least one tilted guide along which said guide slides due to gravity.

18. A method for operating the self-closing device according to claim 1, wherein in a first step said slider is at a first idle position and holds with a tooth of a first pin of said drawing element, a second return step wherein said slider is drawn back by an external thrust exerted on said first pin of said drawing element in a second position, wherein a third pin and a fourth pin are engaged in an intermediate lateral cavity and in a rear curve of said guide concurrently releasing said first pin from said tooth and leaving said drawer free to move along a small extraction portion until a second pin engages with a projection of said slider, said projection through a cam moving said slider once back within said guide, a third extraction step wherein said slider is drawn into said guide in contrast to a first spring until said third pin engages into a front curve of said guide moving said slider into a third position wherein said first pin is released from said tooth leaving said drawer free, a fourth closing step wherein said drawing element extends beyond said slider with said second shorter pin, while said first pin engages with said projection releasing said third pin from said front curve and engaging said first pin with said tooth so that said slider returns to said first position due to the action of said first spring, moving said drawer to closed position.

* * * * *